US006548959B1

(12) United States Patent
Harada et al.

(10) Patent No.: US 6,548,959 B1
(45) Date of Patent: Apr. 15, 2003

(54) DISCHARGE TUBE WITH SUBSTANTIALLY EXPOSED CATHODE TIP PORTION FOR USE AS A LIGHT SOURCE

(75) Inventors: Nobuharu Harada, Hamamatsu (JP); Syoji Ishihara, Hamamatsu (JP); Yuji Shimazu, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 32 days.

(21) Appl. No.: 09/664,097

(22) Filed: Sep. 19, 2000

Related U.S. Application Data

(63) Continuation-in-part of application No. PCT/JP99/01416, filed on Mar. 19, 1999.

(30) Foreign Application Priority Data

Mar. 20, 1998 (JP) ..... 10-072233

(51) Int. Cl.[7] ..... H01J 17/04
(52) U.S. Cl. ..... 313/632; 313/331; 313/336
(58) Field of Search ..... 313/631, 632, 313/633, 311, 336, 331, 332, 326

(56) References Cited

U.S. PATENT DOCUMENTS 4,906,895 A * 3/1990 Pabst et al. ..... 313/632
5,629,585 A 5/1997 Altmann et al. ..... 313/570

FOREIGN PATENT DOCUMENTS

| | | |
|---|---|---|
| JP | 60-131751 | 7/1985 |
| JP | 61-90157 | 6/1986 |
| JP | 63-24539 | 2/1988 |
| JP | 64-24355 | 1/1989 |
| JP | 1-213952 | 8/1989 |
| JP | 08-273622 | 10/1996 |
| JP | 9-92201 | 4/1997 |
| JP | 09-129179 | 5/1997 |
| JP | 11-288689 | 10/1999 |

* cited by examiner

*Primary Examiner*—Vip Patel
*Assistant Examiner*—Joseph Williams

(57) ABSTRACT

In order to meet various requirements for discharge tubes for use as light sources, including easiness of production, stability of discharge, long lifetime, etc. without any contradiction between them, a discharge tube of the present invention involves an improvement in the discharge tube for use as a light source constructed to effect arc discharge in a discharge gas atmosphere between a cathode 2, having a cathode tip portion 22 fixed to a lead rod 21, and an anode 3 opposed thereto while keeping the cathode and anode enclosed in the gas. The cathode tip portion has a cusp pointed toward the anode and consists of a refractory metal substrate 221 of an impregnated type or a sintered type containing an electron-emissive material, and a refractory metal coating 222 covering the surface except at the tip portion of the cusp. At the tip portion of the cusp in the cathode tip portion, the metal substrate is exposed without being covered by the coating, or the coating is made so thin or porous as to substantially expose the metal substrate.

6 Claims, 1 Drawing Sheet

DISCHARGE TUBE WITH SUBSTANTIALLY EXPOSED CATHODE TIP PORTION FOR USE AS A LIGHT SOURCE

RELATED APPLICATION

The present application is a continuation-in-part application of PCT application No. PCT/JP99/01416 filed on Mar. 19, 1999, designating U.S.A., now pending.

BACKGROUND OF THE INVENTION

1. Field of the Invention

The present invention relates to a discharge tube for use as a light source and, more particularly, to a discharge tube serving as a light source like a xenon short arc lamp, a mercury-xenon lamp, or the like.

2. Related Background Art

Examples of such discharge tubes include those disclosed in Japanese Patent Application Laid-Open No. S60-131751 (which will be referred to hereinafter as Reference 1), Japanese Utility Model Application Laid-Open No. S61-90157 (which will be referred to hereinafter as Reference 2), Japanese Patent Application Laid-Open No. H01-213952 (which will be referred to hereinafter as Reference 3), Japanese Patent Application Laid-Open No. H08-273622 (which will be referred to hereinafter as Reference 4), Japanese Patent Application Laid-Open No. H09-92201 (which will be referred to hereinafter as Reference 5), and Japanese Patent Application Laid-Open No. H09-129179 (which will be referred to hereinafter as Reference 6).

Reference 1 discloses the discharge tube for use as a light source having a cathode in which a porous. metal substrate of tungsten or the like is impregnated with an electron-emissive material such as alkaline earth metals or the like. This Reference 1 describes that stable and good discharge is implemented by the use of the metal electrode impregnated with the electron-emissive material.

Reference 2 discloses the discharge tube in which only a sharp end of a sharply tipped, impregnated. cathode is coated with a metal to lower the work function, such as iridium or the like. This Reference 2 describes that the coating of the metal to lower the work function only on the sharp end can decrease deterioration of the electrode and stabilize electric discharge.

Reference 3 discloses the discharge tube having the cathode in which a coating of a refractory metal is formed over the entire surface without exposing the surface at a cusped tip of the cathode with a cusp. This Reference 3 describes that the thin-film coating of the refractory metal over the entire surface can stabilize the arc and decrease fluctuation of the arc.

Reference 4 discloses the cathode for discharge tube in which a metal electrode like a sharp, thin tungsten wire is buried along the axial direction in the central part of the impregnated cathode. This Reference 4 describes that the lifetime can be extended, because there exists no impregnant in the metal electrode in the center.

Reference 5 discloses the cathode for discharge tube in which a sharp electrode in the central part of the impregnated cathode is made of a porous metal material and in which the outer surface of an impregnated metal portion surrounding this center electrode is coated with a refractory metal. This Reference 5 describes that operating temperatures can be lowered because of the porous structure of the center electrode under supply of the electron-emissive material from the surrounding impregnated metal portion and that evaporation of the electron-emissive material can be suppressed by the coating on the outer surface.

Reference 6 discloses the cathode in which a mixture of a refractory metal and an electron-emissive material is stuffed into the inside of a cap-shaped metal case with a conical bored tip. This Reference 6 describes that the structure can decrease evaporation and wear of the cathode.

A variety of improvements and ideas have been presented heretofore concerning the cathodes in the discharge tubes as light sources as described above, but there is no cathode available yet to satisfy the various requirements for the discharge tubes as light sources, including easiness of production, stability of discharge, long lifetime, and so on, without any contradiction between them.

For example, in Reference 3 proposed as solution technology to the problems in References 1 and 2, the evaporation of the electron-emissive material is intended to be prevented by coating the entire surface of the tip part of the cathode with the refractory metal. This structure, however, makes it difficult to implement good emission of electrons from the cusped tip and, as detailed hereinafter in comparison with the present invention, it fails to restrain the evaporation of the electron-emissive material by the above coating after all.

In Reference 4, the sharp metal electrode of the tungsten wire is exposed at the tip of the cathode, but this makes it difficult to emit electrons at low temperatures from the cusped tip. Then Reference 5 suggests the cathode in which the center electrode is porous and is surrounded by the metal containing the electron-emissive material, but this makes it difficult to implement good electron emission from the cusped tip, as described hereinafter in comparison with the present invention.

On the other hand, Reference 6 describes that the evaporation of the electron-emissive material can be prevented by the covering of the metal cap, but it is not easy to produce the tip part of the cathode in this structure in the level of practical use. Particularly, the temperatures at the cusped tip become high around 1500° C. during operation and it is difficult to press the porous metal into the metal cap so as to implement stable emission of electrons at such high temperatures over the long term.

SUMMARY OF THE INVENTION

An object of the present invention is, therefore, to provide a discharge tube for use as a light source that can realize the stability of discharge, long lifetime, easiness of production, etc. without any contradiction.

A discharge tube of the present invention comprises a vessel filled with a discharge gas, a cathode placed in this vessel and having a tip portion fixed to a lead rod, and an anode placed opposite to the tip portion of the cathode in the vessel; the cathode has a cusp pointed toward the anode, a metal substrate of an impregnated type in which a porous, refractory metal is impregnated with an electron-emissive material or a sintered type in which a refractory metal containing an electron-emissive material is sintered, and a coating of a refractory metal which covers a surface on the base end side of the cusp within.a surface of the metal substrate; an exposed portion in which the metal substrate is exposed without being covered by the coating is provided at a tip portion of the cusp of the cathode; or, the coating is made so thin or porous as to substantially expose the metal substrate at the tip portion of the cusp of the cathode.

According to the present invention, the tip portion of the cathode is made of the metal substrate containing the electron-emissive material or impregnated therewith, and the surface thereof on the base end side of the cusp is covered by the coating of the refractory metal; therefore, the evaporation of the electron-emissive material is prevented during operation. On the other hand, since at the tip portion of the cusp the metal substrate is exposed without being covered by the coating of the refractory metal or the coating is made so thin or porous as to substantially expose the metal substrate containing the electron-emissive material or impregnated therewith, electron emission is promoted by the electron-emissive material diffusing to the tip portion of the cusp. For this reason, electrons are emitted efficiently at relatively low temperatures, so as to stabilize the discharge, and the evaporation of the electron-emissive material is also prevented, so as to permit attainment of longer lifetime. Further, the tip portion of the cathode of the present invention can be realized in the simple structure wherein the coating of the refractory metal is formed on the surface of the metal substrate except for the tip portion of the cusp, and this permits provision of the discharge tube as a light source with high practical utility.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

An embodiment of the present invention will be described below in detail with reference to the accompanying drawings. In the description of the drawings, like elements will be denoted by the same reference symbols and redundant description will be avoided.

Figure 1:
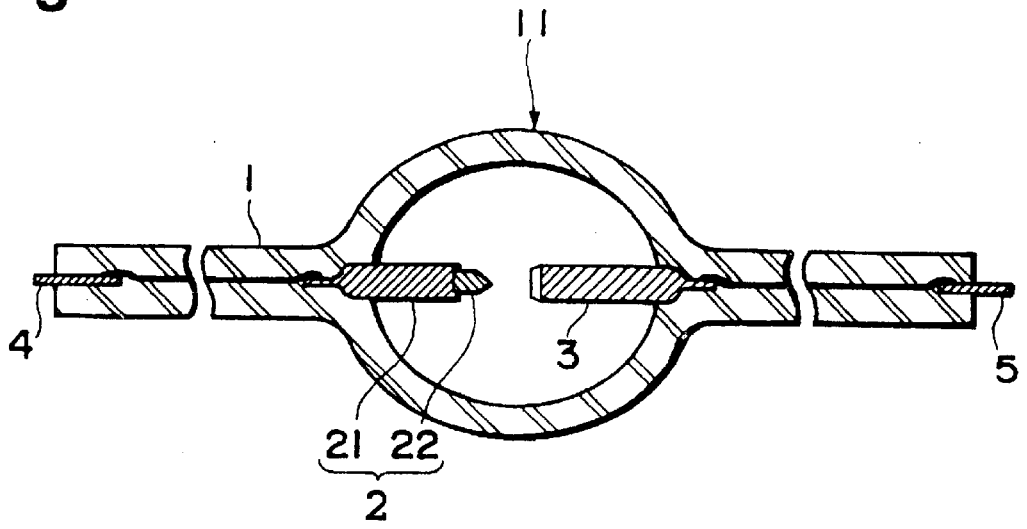
FIG. 1 is a longitudinal, cross-sectional view of a xenon short arc lamp as an embodiment.
Figure 2:
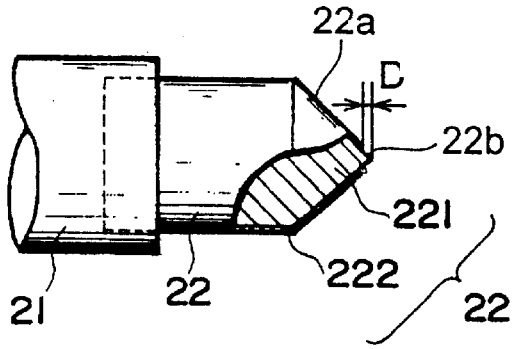
FIG. 2 is a side view to show the structure of the cathode in the embodiment.

FIG. 1 is the longitudinal, cross-sectional view to show the structure of the xenon short arc lamp according to the embodiment and FIG. 2 is the side view, partly broken, of the structure of the tip portion of the cathode. A rodlike glass bulb 1 has a hollow gas enclosure 11 formed in a middle portion thereof and the inside of the gas enclosure is filled with a discharge gas such as xenon or the like. Inside the gas enclosure 11 there are the cathode 2 and the anode 3 opposed to each other, and external terminals 4, 5 electrically connected to the cathode 2 and to the anode 3, respectively, are attached to the both ends of the glass bulb 1.

The cathode 2 has a lead rod 21 of molybdenum the base of which is fixed to the glass bulb 1 of quartz, and a cathode tip portion 22 the base of which is fixed to the free end of the lead rod 21. The cathode tip portion 22 is formed in the bullet shape with a conical cusp pointed toward the anode 3 and is comprised of a metal substrate 221 and a metal coating 222. The metal substrate 221 is made by impregnating porous tungsten (refractory metal) with barium (electron-emissive material), and the metal coating 222 of iridium (refractory metal) is deposited by CVD on the slope of, the cone and on the side surface of the cylindrical base except at the tip portion of the cusp.

The metal coating 222 of iridium is about 2000 Å thick and can be formed not only by CVD but also by sputtering or the like. The closer the position to the tip of the cusp, the higher the temperature becomes thereat in the cathode tip portion 22 during operation; and, the closer the position to the tip of the cusp, the more important role the position plays in terms of diffusion of the electron-emissive material. Therefore, the metal coating 222 is an indispensable element on the slope of the cone, but there will occur no trouble even if the metal substrate 221 is exposed on the side surface of the cylindrical base.

Preferably, the metal substrate 221 is exposed without presence of iridium at the tip portion of the cusp in the cathode tip portion 22. This structure can be realized, for example, by depositing iridium over the entire surface and thereafter removing iridium from the tip portion of the cusp by polishing with sandpaper. In another method, iridium can be removed from the tip portion of the cusp by so-called ablation to irradiate it with pulsed laser beams. In still another method, iridium is deposited with a mask on the tip portion of the cusp whereby the metal substrate 221 containing the electron-emissive material is exposed at the tip portion of the cusp.

Here an exposure rate at the tip portion of the cusp, i.e., a rate of a surface area of cusp exposed portion 22*b* to a surface area of cusp side surface 22*a*, is set preferably in the range of 2% to 80% and more preferably in the range of 2% to 30% from the functional aspect. Alternatively, it is preferable from the functional aspect that the perpendicular distance D of exposure from the vertex of the cusp to the end of the exposed portion be in the range of 0.1 mm to 4 mm and, more preferably, in the range of 0.1 mm to 0.4 mm.

In a further method, the metal coating 222 at the tip portion of the cusp is made physically "weaker" than the other portions by adjusting the thickness and deposition conditions of the metal coating 222, and predischarge is conducted lightly after assembly of the discharge tube to selectively remove iridium from the tip portion of the cusp, thereby exposing the metal substrate 221. This predischarge can be carried out by supplying dc or ac power, but it can also be executed as part of so-called aging.

At the tip portion of the cusp in the cathode tip portion 22, the metal substrate 221 is preferably exposed without presence of iridium in the discharge gas atmosphere. However, the excellent effect of the present invention can be generally demonstrated as long as the metal substrate is exposed in a substantial sense though not exposed perfectly. The phrase "exposed in a substantial sense" stated herein means that the electron-emissive material diffusing inside the metal substrate 221 is in a state in which it is exposed to the discharge gas when arriving at the tip portion of the cusp. In other words, a first condition is that the cathode tip portion is in a material condition in which during operation the electron-emissive material can diffuse sufficiently to the surface of the metal substrate 221 at the tip portion of the cusp and a second condition is that the tip portion of the cusp is in a material condition in which the electron-emissive material can be kept in contact with the discharge gas in density approximately several to several ten times that on the metal coating 222 formed on the slope of the cone in the cathode tip portion 22.

Describing it from the microscopic aspect, for example, even if fine iridium grains are scattered in the island shape at the tip portion of the cusp, the electron-emissive material like barium can be supplied readily to the exposed surface of the metal substrate 221 at the tip portion of cusp to facilitate emission of electrons into the discharge gas. At this time, since the metal substrate 221 on the slope of the cone in the cathode tip portion 22 is covered by the metal (iridium) coating 222, the evaporation of the electron-emissive material is prevented.

From the microscopic view of the metal coating 222, it is a film in which a lot of fine iridium grains having the particle sizes of several ten to several hundred angstrom order are stacked at random. Supposing the thickness of the deposition of iridium grains at the tip portion of the cusp is a fraction of several to several tens of that on the slope of the cone, it can be mentioned in the relativity between the slope of the cone and the tip portion of the cusp that the metal substrate 221 at the tip portion of the cusp is in a "substantially exposed" state. Specifically, when the distance is 2.0 mm between the electrodes, emission of light will occur with flow of electric current of 8 A. Further, it can also be contemplated that a difference is made in the size or deposition density of the iridium grains. For example, if the grain size is set large at the tip portion of the cusp while small on the slope of the cylinder, the electron-emissive material included in the metal substrate 221 can be prevented from evaporating on the slope of the cone and electrons can be supplied readily into the discharge gas through the electron-emissive material having diffused to the tip portion of the cusp.

Here the refractory metal forming the metal substrate 221 needs to be a metal that resists deterioration and deformation at high temperatures during operation and that can contain the electron-emissive material by impregnation or sintering. Such a metal can be either of molybdenum, tantalum, and niobium, in addition to tungsten, but tungsten is a most preferable metal in either of the impregnated type and the sintered type.

The electron-emissive material needs to be a metal having a low work function and readily emitting electrons and, desirably, is one resistant to evaporation under high temperatures. Such a material can be one selected from the alkaline earth metals such as calcium, strontium, etc. as well as barium; lanthanum, yttrium, cerium, and so on. The material can be a mixture of two or more metals, or an oxide.

Further, it is important that the metal forming the metal coating 222 be a refractory metal resistant to the high temperatures during operation, and if it is a metal to lower the work function it will further promote emission of electrons from the electron-emissive material. Such a metal is most preferably iridium, but can be one of rhenium, osmium, ruthenium, tungsten, hafnium, and tantalum. The coating can be a mixture of two or more metals, or a laminate film.

Next, the remarkable action and effect will be described below based on specific examples by the inventor.

The porous metal substrate of tungsten was impregnated with barium oxide by the method in Reference 1, and a coating of iridium was formed by CVD in the thickness of 2000 Å on the surface of the conical part and on the surface of the cylindrical part except at the tip portion of the cusp. The cathode with this cathode tip portion, and the anode were mounted in the quartz bulb, the discharge gas was charged thereinto, and the discharge tube obtained was subjected to dc operation. The discharge tube of this example maintained the luminous efficiency extremely higher than that of the conventional discharge tubes of light sources, even after a lighting test for the long period of 1000 hours, which verified as long a lifetime as it could be considered as a breakthrough. The inside was kept in a clean state without deposition of scattered barium absorbing ultraviolet rays at the wavelength of 365 nm on the internal surface of the emission area of the bulb, unlike the conventional tubes.

On the analogy of the results of comparative experiments by the inventor, the following mechanism can conceivably account for the remarkable action and effect described above.

First, when the coating of iridium covers the entire surface of the metal substrate so as to keep the surface of the metal substrate containing barium from being exposed, as in Reference 3, barium, provided for the special purpose, becomes unable to act as an electron-emissive material at low operating temperatures, so that the operating temperatures must be high, which increases an amount of evaporation of the electrode material and thus shortens the lifetime of the lamp. This means that the iridium coating provided for the purpose of preventing the evaporation of the electron-emissive material by "provision of cover" can be the cause of the high-temperature operation to make the evaporation of the electron-emission substance inevitable conversely.

On the other hand, when the cathode is formed in the structure in which the porous metal member containing the electron-emissive material is fitted around the porous center electrode containing no electron-emissive material, as in Reference 5, a considerable time is necessary for diffusion of the electron-emissive material to the tip of the center electrode during aging and the temperature becomes extremely high, particularly, at the tip portion of the cusp. This can result in deteriorating the porous metal at the tip portion of the cusp because of melting, softening, or the like and this may be a hindrance to suitable diffusion of the electron-emissive material during normal operation. It is not easy to form the two porous metals separately and fit them to each other so as to allow smooth diffusion of the electron-emissive material from the peripheral metal body to the center electrode.

In contrast to it, at the cathode tip portion applied to the discharge tube as a light source in the present embodiment, the iridium coating is formed except at the tip portion of the cusp of the porous metal substrate containing the electron-emissive material, so that the porous metal substrate is selectively exposed (or substantially exposed) at the tip portion of the cusp. Because of this structure, the electron emission is initiated from barium at the tip portion of the cusp in a state of relatively low temperature slightly over 1000° C., and thus the operating temperatures are kept low. Since the region around the tip portion of the cusp contributing to discharge, i.e., on the base end side of the tip portion of the cusp (the slope of the cone) is covered by iridium being the refractory metal, it is expected that barium being the electron-emissive material can be prevented from evaporating.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A discharge tube comprising:

a vessel filled with a discharge gas;

a cathode placed in said vessel and having a tip portion fixed to a lead rod; and an anode placed opposite to said tip portion of said cathode in said vessel, wherein said cathode comprises;

a cusp pointed toward said anode;

a metal substrate of an impregnated type in which a porous refractory metal is impregnated with an electron-emissive material or a sintered type in which a refractory metal containing an electron-emissive material is sintered; and a coating of a refractory metal which covers a surface on the base end side of said cusp, and wherein an exposed portion in which said metal substrate is exposed without being covered by said coating is provided at a tip portion of said cusp of said cathode.

2. The discharge tube according to claim 1, wherein a rate of a surface area of said exposed portion to a surface area of a side surface of said cusp is in the range of 2% to 80%.

3. The discharge tube according to claim 1, wherein a rate of a surface area of said exposed portion to a surface area of a side surface of said cusp is in the range of 2% to 30%.

4. The discharge tube according to claim 1, wherein a perpendicular distance from the vertex of the cusp to the end of the exposed portion is in the range of 0.1 mm to 4 mm.

5. The discharge tube according to claim 1, wherein a perpendicular distance from the vertex of the cusp to the end of the exposed portion is in the range of 0.1 mm to 0.4 mm.

6. A discharge tube comprising:

a vessel filled with a discharge gas;

a cathode placed in said vessel and having a tip portion fixed to a lead rod; and an anode placed opposite to said tip portion of said cathode in said vessel, wherein said cathode comprises;

a cusp pointed toward said anode;

a metal substrate of an impregnated type in which a porous refractory metal is impregnated with an electron-emissive material or a sintered type in which a refractory metal containing an electron-emissive material is sintered; and a coating of a refractory metal which covers a surface on the base end side of said cusp, and wherein a substantially exposed portion in which the coating is porous is provided at a tip portion of said cusp of said cathode.

* * * * *